US012090364B2

(12) United States Patent
Chang Chien

(10) Patent No.: US 12,090,364 B2
(45) Date of Patent: Sep. 17, 2024

(54) ANKLE-SPINNING EXERCISE APPARATUS

(71) Applicant: Sung-Shan Chang Chien, Kaohsiung (TW)

(72) Inventor: Sung-Shan Chang Chien, Kaohsiung (TW)

( * ) Notice: Subject to any disclaimer, the term of this patent is extended or adjusted under 35 U.S.C. 154(b) by 161 days.

(21) Appl. No.: 17/944,194

(22) Filed: Sep. 14, 2022

(65) Prior Publication Data

US 2023/0233903 A1 Jul. 27, 2023

(30) Foreign Application Priority Data

Jan. 26, 2022 (TW) ..... 111103412

(51) Int. Cl.
*A63B 23/08* (2006.01)

(52) U.S. Cl.
CPC ..... *A63B 23/08* (2013.01)

(58) Field of Classification Search
CPC .... A63B 21/015; A63B 21/0435; A63B 23/08
See application file for complete search history.

(56) References Cited

U.S. PATENT DOCUMENTS 6,342,042 B1 * 1/2002 Martin ..... A61H 1/0237 601/84
6,371,897 B1 * 4/2002 Huang ..... A61H 1/0218 482/148
6,572,568 B2 * 6/2003 Huang ..... A61H 1/0237 601/87
6,749,539 B2 * 6/2004 Hsieh ..... A61H 1/0237 601/28
9,682,002 B2 * 6/2017 Belin ..... A61H 1/0244
10,888,486 B2 * 1/2021 Baek ..... A61H 1/0266

* cited by examiner

*Primary Examiner* — Zachary T Moore
(74) *Attorney, Agent, or Firm* — Leong C. Lei

(57) ABSTRACT

An ankle-spinning exercise apparatus includes a casing unit, a power unit arranged in an interior of the casing unit, and a support unit drivable by the power unit to perform a rotation motion. A user may place an ankle on the support unit, and the power unit drives the support unit to perform rightward and leftward rotation motions, so that the entire lower limb (leg) of the user is driven to do a spinning like rotating motion, to thereby exercise the muscles and the meridian system of the entire lower limb of the user by which an effect of body building and heath care can be achieved.

14 Claims, 12 Drawing Sheets

ANKLE-SPINNING EXERCISE APPARATUS

TECHNICAL FIELD OF THE INVENTION

The present invention relates generally to an ankle-spinning exercise apparatus, and more particularly to an ankle-spinning exercise apparatus that enables the entire lower limbs (legs) of a user to be driven to rotate in a spinning-like motion so as to exercise the muscles and the meridian systems of the entire lower limbs to thereby achieve the effects of body building and health care.

DESCRIPTION OF THE PRIOR ART

With the prosperity of the human society and the diversification of living style, there are more and more people who work by brain rather than physical labor. Sports and fitness are now the main stream of the modern society. This gives rise to prosperous development of all sorts of commercial exercise facilities and sports and fitness equipment and apparatus. Various exercise equipment has been developed for training of various parts of the human body, such as strengthening of the upper limbs, strengthening of the core muscles, and strengthening of the lower limbs.

It is known that natural full-body exercises, such as jogging and swimming are the better ways for body building in view of body healthy. However, in case of aging and injury of the lower limbs or other body portions, it may not be possible for a human body to take the great forces induced at the instant of starting to jog and, in an even worse case, the body may suffer a great pain even for just walking, or in other instances where no proper facility may be available at a right time, people have to take alternatives for doing exercise with indoor fitness equipment or apparatuses.

In the traditional Chinese concept of health care, the legs have six major meridian lines extending upward from the soles, including gallbladder meridian, kidney meridian, bladder meridian, and the likes. It is commonly acknowledged that the aging of a human body starts from the aging of the feet. In this regard, the healthiness of the feet is the most important part of body heath care. It is also noted that the foot soles are the terminal portions of the human body that are furthest from the heart, and consequently, motions of the foot soles are the most important for human body health care. Thus, it is a challenge for the fitness and exercise equipment manufacturers to provide an exercise apparatus that allow people to timely and easily exercise the legs of the lower limbs.

SUMMARY OF THE INVENTION

The primary objective of the present invention is to provide an ankle-spinning exercise apparatus that enables the entirety of the lower limbs (legs) of a user to be driven to rotate in a spinning-like motion so as to exercise the muscles and the meridian systems of the entire lower limbs to thereby achieve the purposes of body building and health care.

For such a purpose, the primary technical solution of the present invention is to provide an ankle-spinning exercise apparatus, wherein the exercise apparatus comprises a casing unit, a power unit arranged in an interior of the casing unit, and a support unit drivable by the power unit to do a rotating motion. The support unit functions to receive an ankle of a user to place thereon.

The efficacy that the present invention may achieve with the above primary technical solution is that the user may place the ankle on the support unit, and the power unit drives the support unit to perform leftward and rightward rotation motions to drive the entire lower limb (leg) of the user to do a spinning like rotating motion, so as to exercise the muscles and the meridian system of the entire lower limb of the user by which an effect of body building and heath care can be achieved.

DETAILED DESCRIPTION OF THE PREFERRED EMBODIMENT

Figure 1:
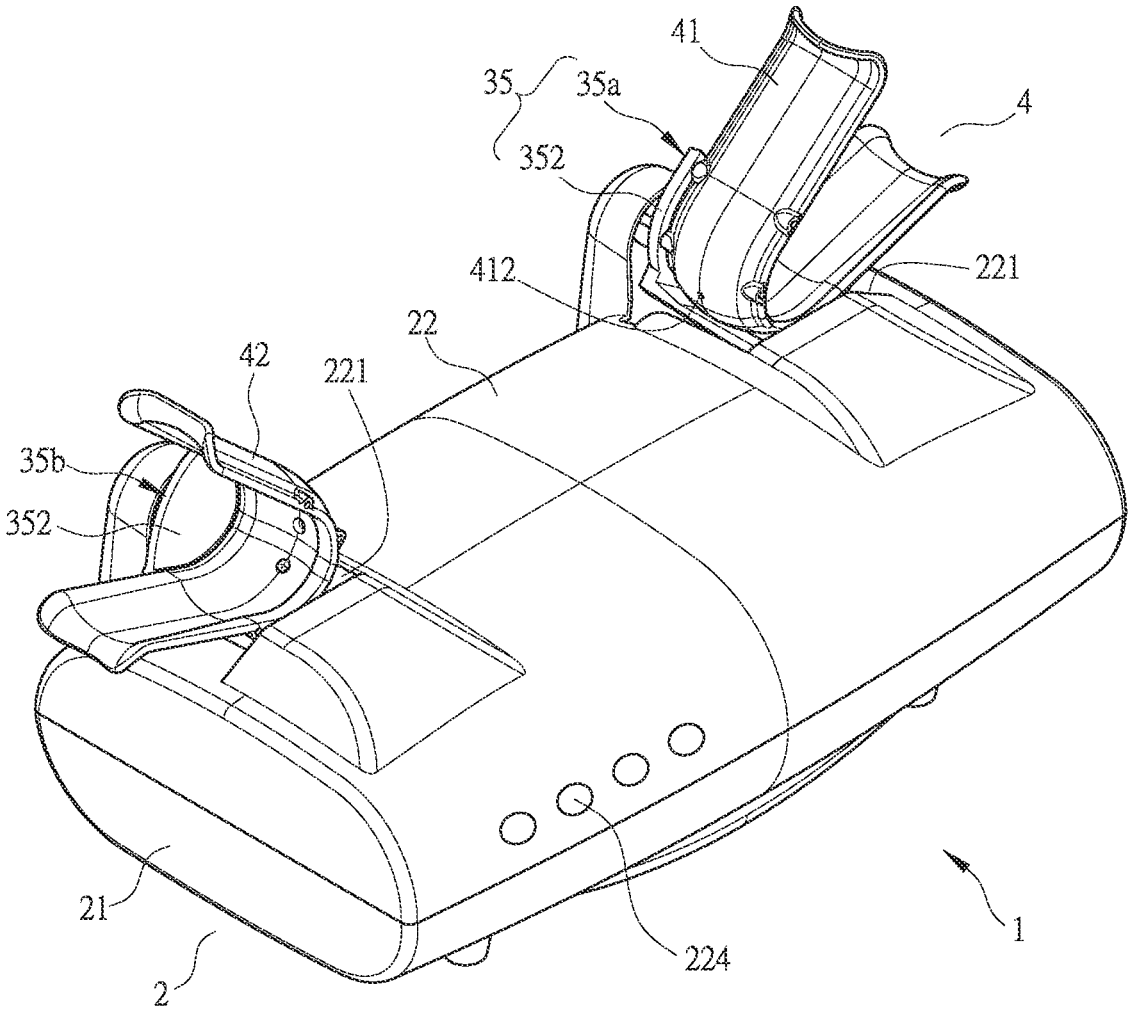
FIG. 1 is a perspective view showing an exercise apparatus according to the present invention.
Figure 2:
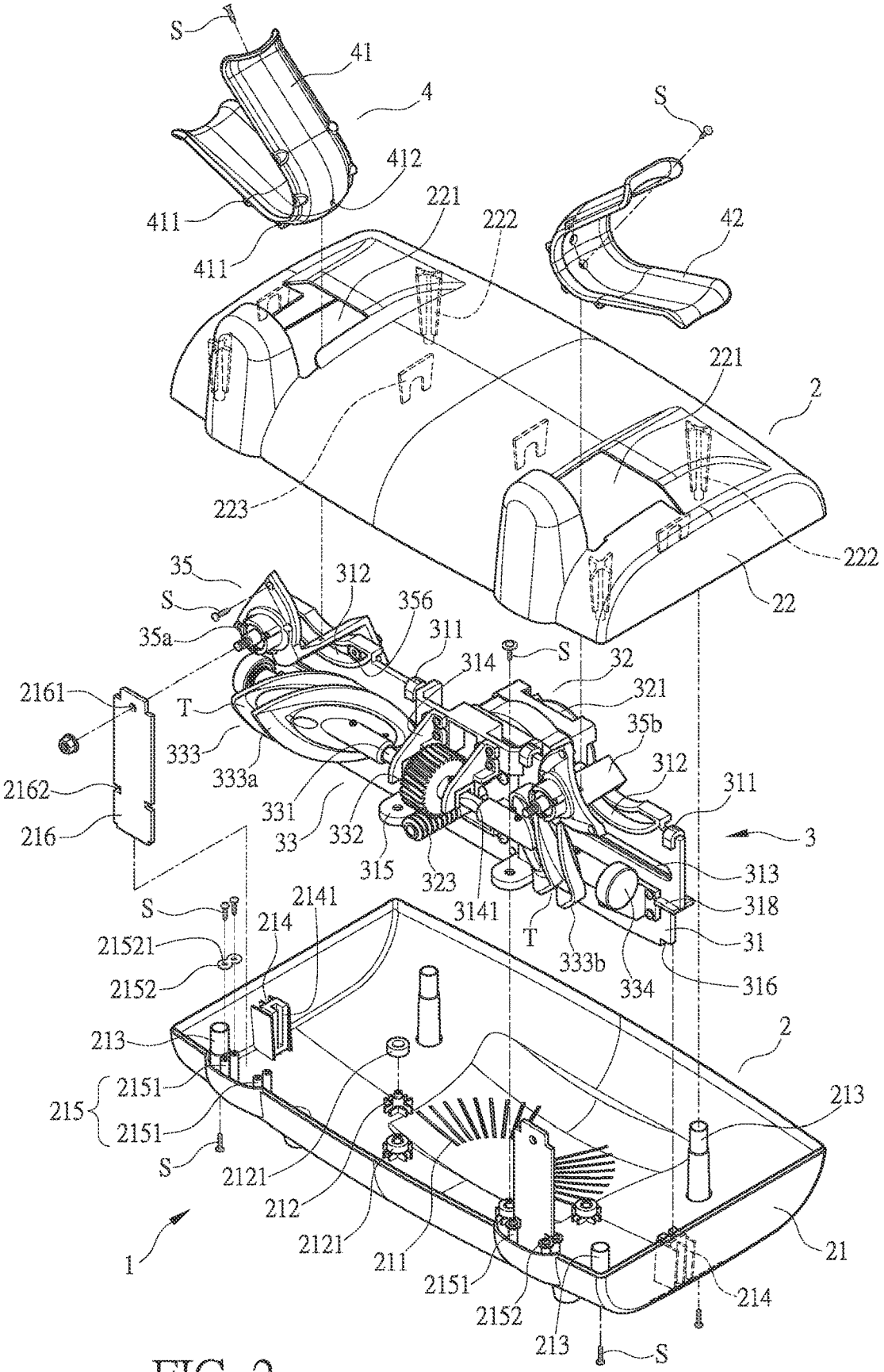
FIG. 2 is an exploded view showing the exercise apparatus according to the present invention.
Figure 3:
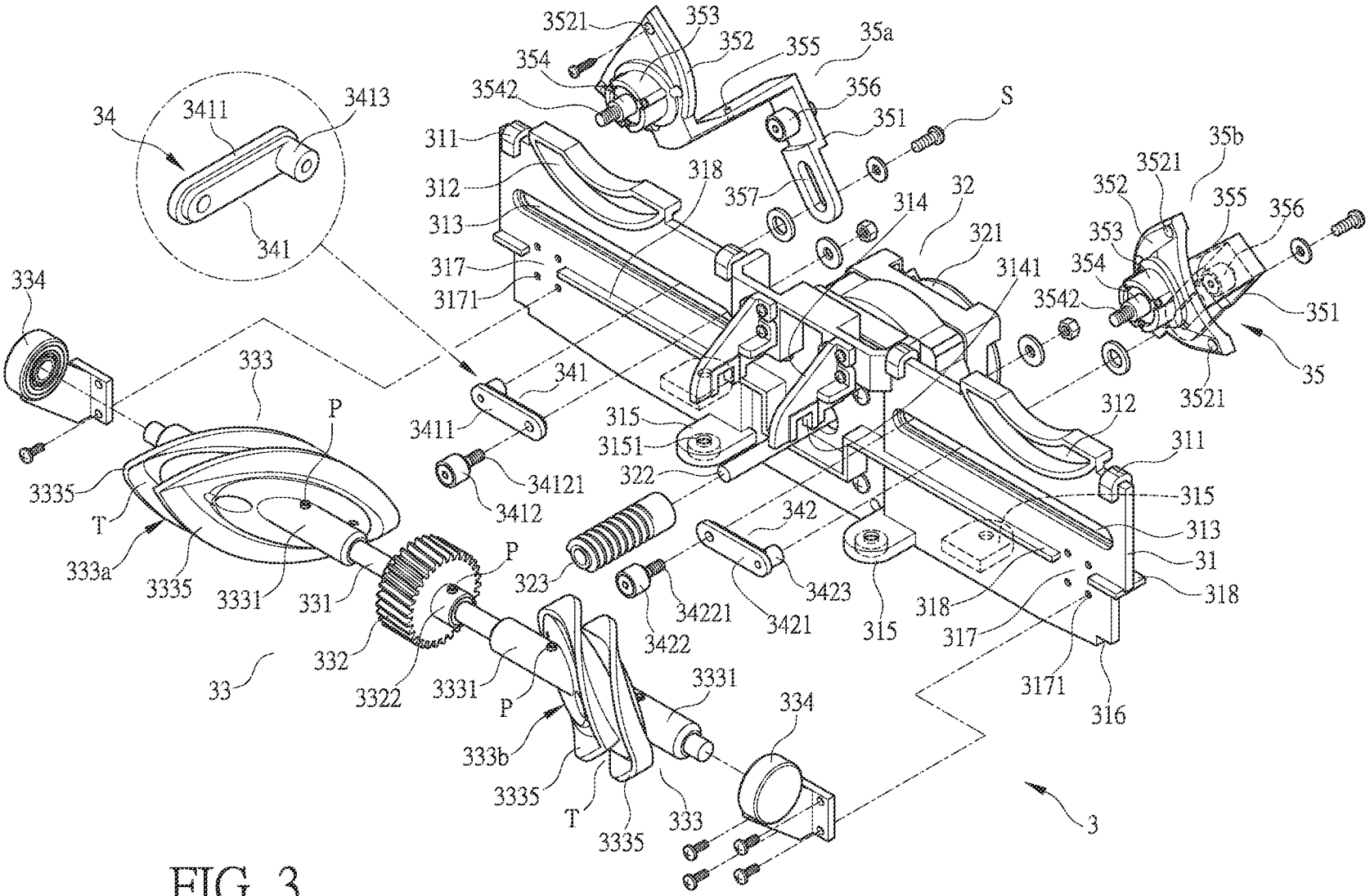
FIG. 3 is an exploded view showing a power unit of the exercise apparatus according to the present invention.
Figure 4:
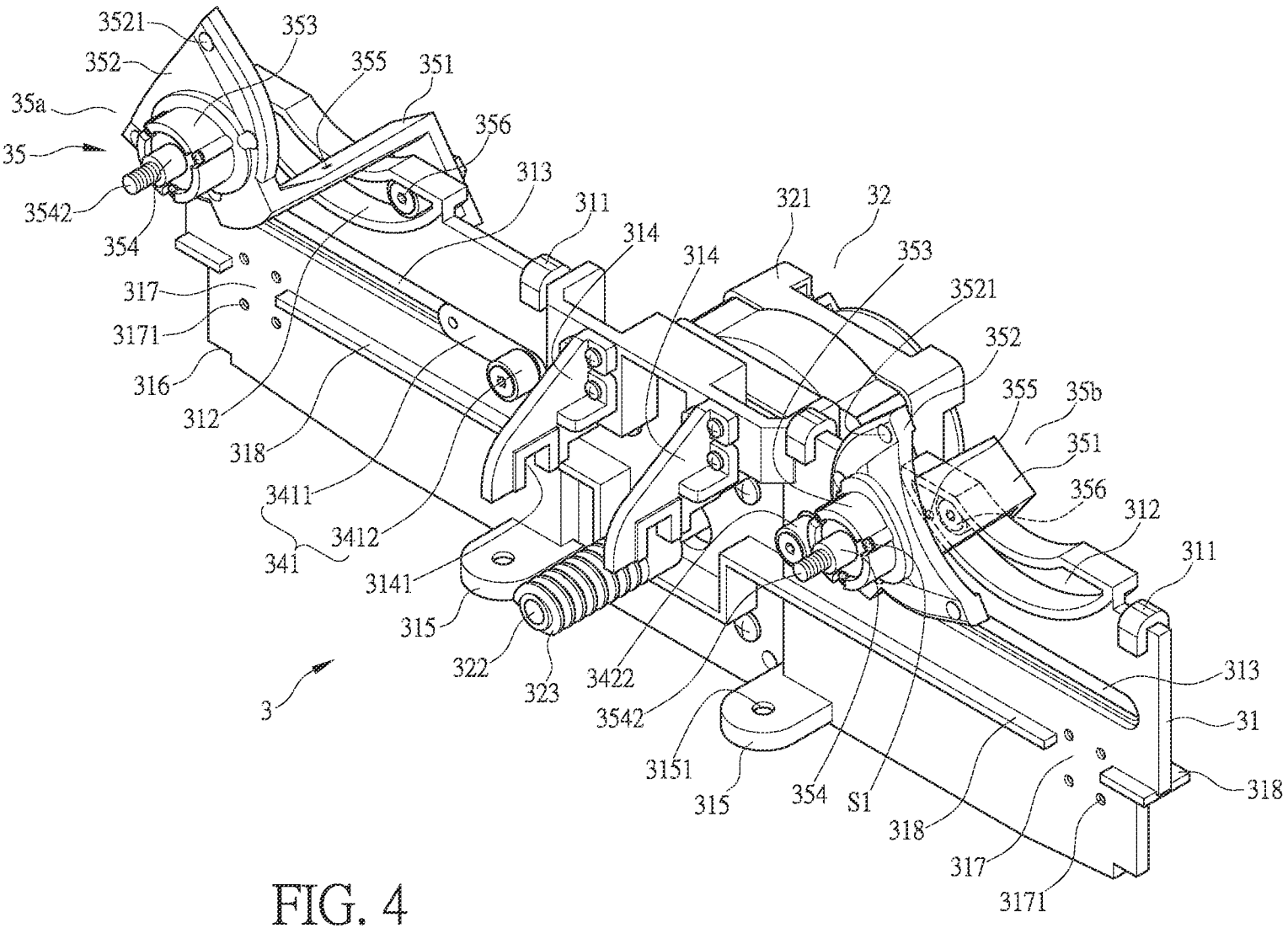
FIG. 4 is a schematic view showing the power unit of the exercise apparatus according to the present invention in a partly assembled form.

Firstly, reference being had to FIGS. 1 and 2, the present invention provides an ankle-spinning exercise apparatus. The exercise apparatus 1 comprises a casing unit 2, a power unit 3 arranged in an interior of the casing unit 2, and a support unit 4 drivable by the power unit 3 to perform a rotation motion.

Figure 5:
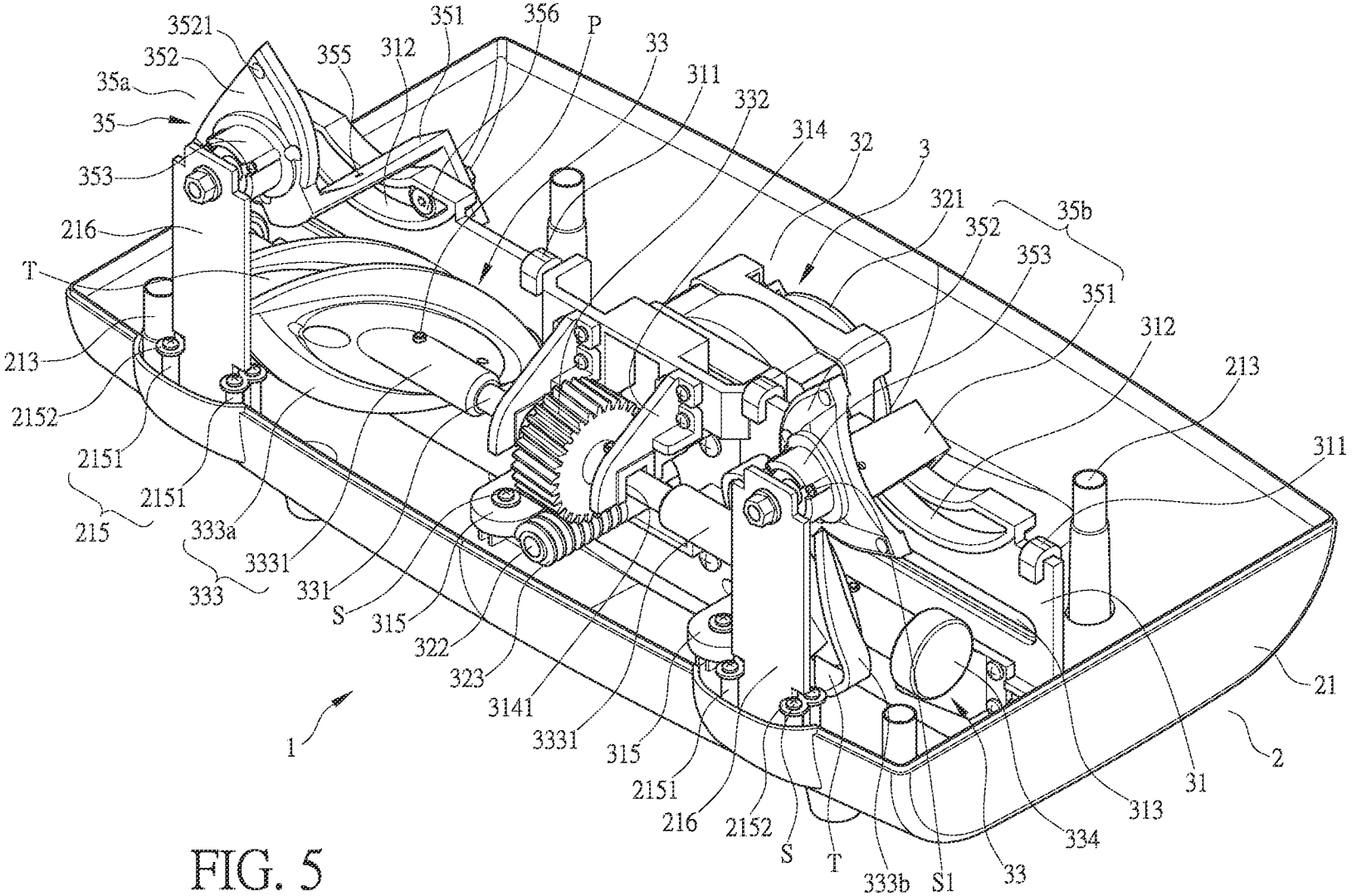
FIG. 5 is a schematic view showing the power unit of the exercise apparatus and a base according to the present invention in an assembled form.
Figure 6:
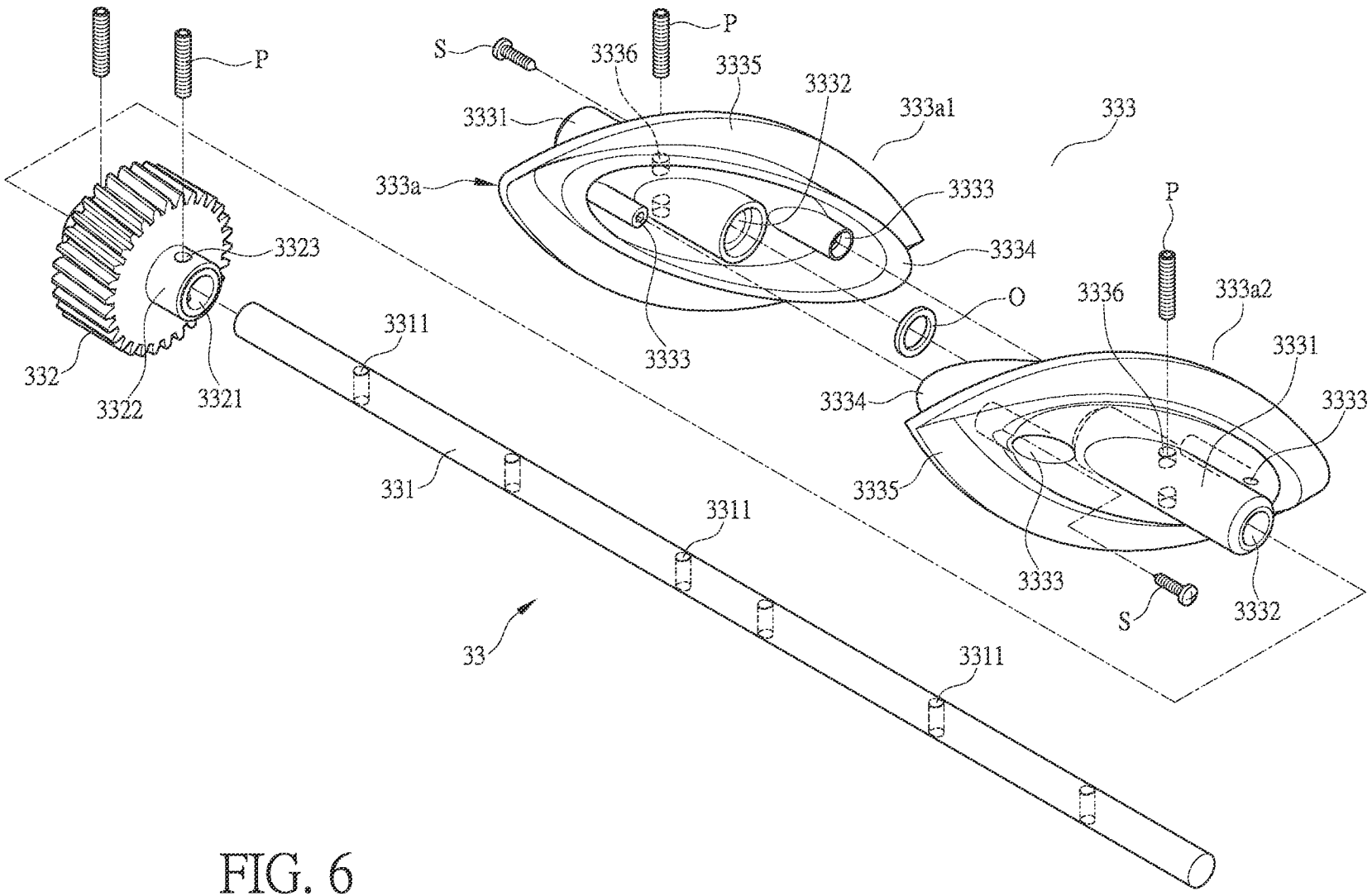
FIG. 6 is an exploded view showing a guide roller assembly of the power unit of the exercise apparatus according to the present invention.
Figure 7:
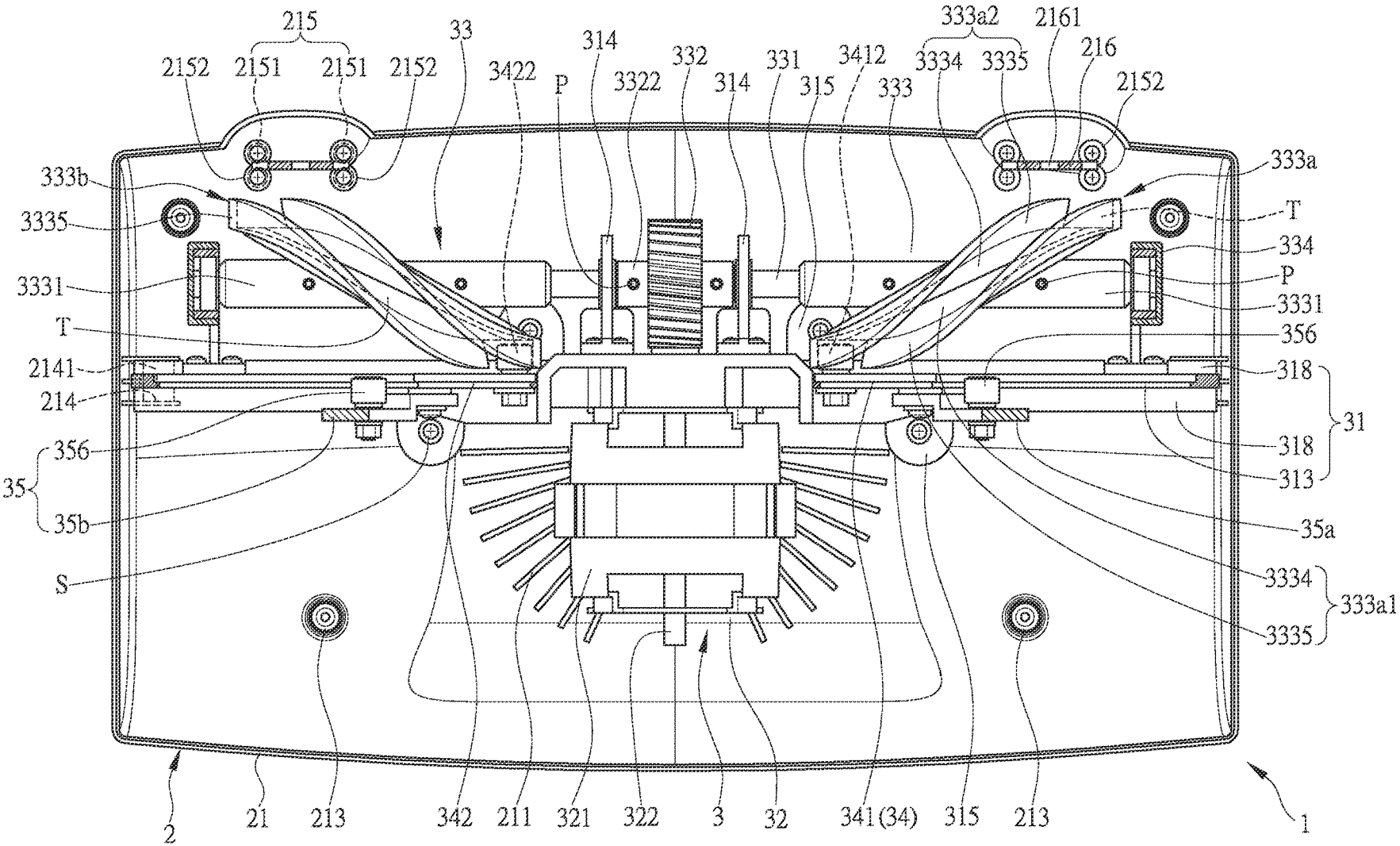
FIG. 7 is a top plan view showing the power unit and the base of the exercise apparatus according to the present invention in an assembled form.
Figure 8:
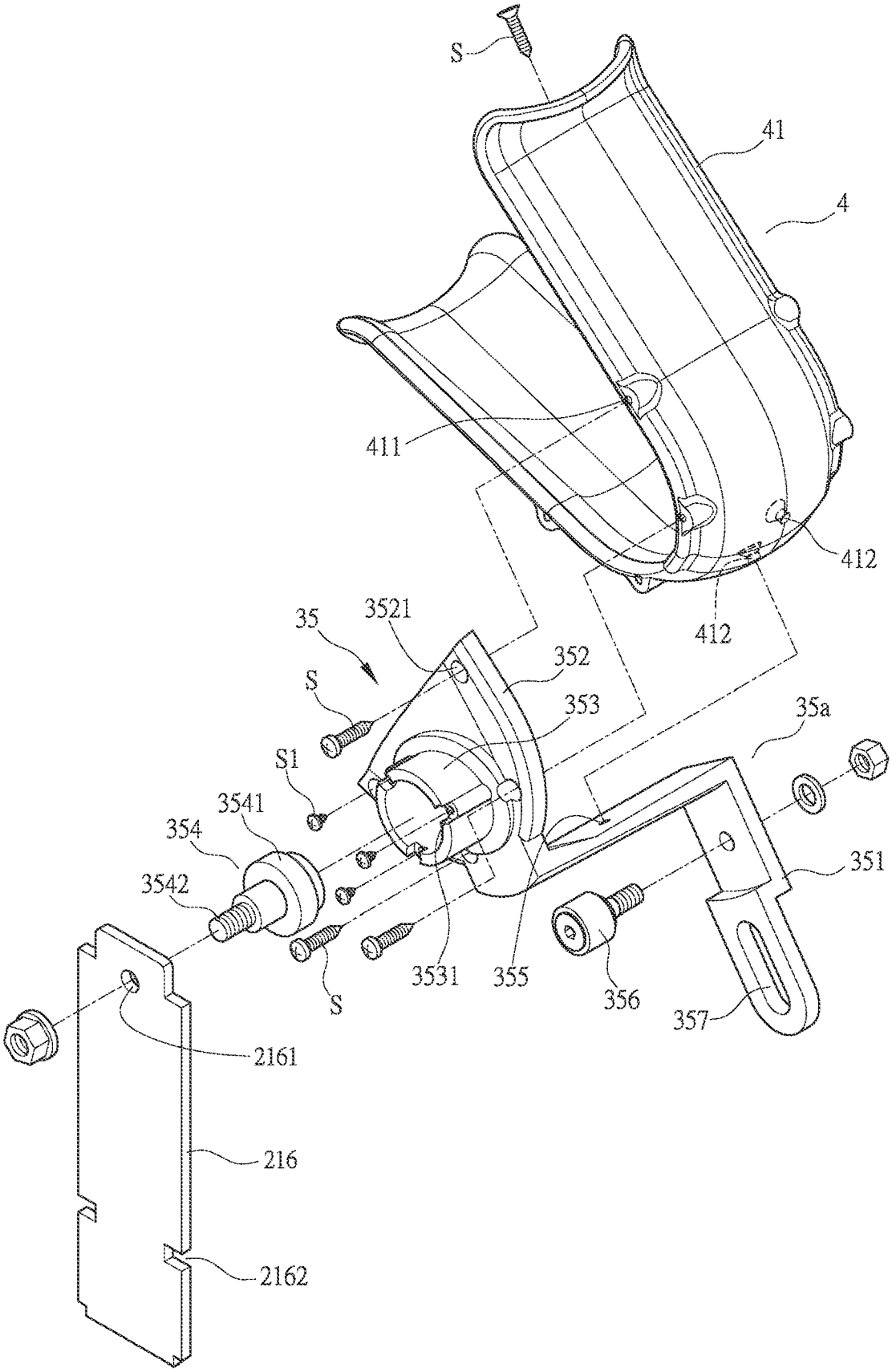
FIG. 8 is an exploded view showing a support unit and a rotating assembly of the exercise apparatus according to the present invention.

As shown in FIGS. 2 and 5, the casing unit 2 includes a base 21 and a cover 22 set on and covering the base 21; the base 21 in the form of a bowl-like structure that includes four sides and a bottom and has a top that is open, the base 21 being provided, in a portion around a center thereof, with a heat dissipation section 211 that is formed of a plurality of openings arranged at intervals and penetrating through the base 21, a plurality of fastening projections 212 being arranged adjacent the heat dissipation section 211, shock-absorbing rings 2121 being fit around outer circumferences of the fastening projections 212, wherein four such the fastening projections 212 are taken as an example of illustration in the drawings; the base 21 is provided with fastening pegs 213 projecting upward from four corners of the bottom thereof; the base 21 is provided with a pair of fitting slots 214 that are arranged, in a manner of being opposite to each other, as a leftward one and a rightward one on two sidewalls of a short side, shock protection pads 2141 having sideway openings being embedded inside the fitting slots 214; the base 21 is provided with fastening sections 215 that are arranged to space from each other in a longitudinal axial direction along a side of a long-side sidewall, meaning the fastening sections 215 include two sets, and the fastening sections 215 are formed of four fastening ribs 2151, and more specifically, the four fastening ribs 2151 are arranged in a manner of two being opposite to the other two, the four fastening ribs 2151 being provided for fastening with two fastening sheets 2152, and more specifically, each of the fastening sections 215 being fastened with two fastening sheets 2152, the fastening sheets 2152 being provided, in two ends thereof, with through openings 21521; each of the fastening sections 215 receives a fastening plate 216 to insert therein, the fastening plates 216 being inserted, in an top-bottom direction of the base 21, into the fastening sections 215, the fastening plates 216 being provided, in an upper portion, with a penetrating through hole 2161, the fastening plates 216 being provided, in a lower portion, with a pair of fixing notches 2162 that are recessed inward and are arranged as a leftward one and a rightward one, wherein when the fastening plates 216 are inserted into the fastening sections 215, the pair of fixing notches 2162 are at a location above the four fastening ribs 2151, so that when the fastening sheets 2152 are fastened by means of fastening elements S to the four fastening ribs 2151, one side of the two fastening sheets 2152 on each of the fastening section 215 can be fit into the pair of fixing notches 2162 of the fastening plate 216, to thereby have the lower end of the fastening plate 16 securely fixed to the fastening section 215.

As shown in FIGS. 1 and 2, the cover 22 is in the form of a hood that includes four sides and a top and has a lower side that is open, so that the cover 22 can be set on and covers the base 21; the cover 22 is provided with two mounting holes 221 that are spaced from each other and penetrating the top; the cover 22 is provided with a plurality of attaching pillars 222 corresponding to the fastening pegs 213 of the base 21, wherein similarly, four such attaching pillars 222 are taken as an example for illustration in the drawings, so that when the cover 22 is set on and covers the base 21, fastening elements S may be applied to fasten through the fastening pegs 213 of the base 21 into the attaching pillars 222 to thereby achieve secured combination of the cover 22 and the base 21; the cover 22 is provided with a plurality of pressing ribs 223 extended downward from an inner side of the top thereof, the pressing ribs 223 being arranged in a manner of projecting toward the base 21, wherein an arrangement of four pressing ribs 223 is taken as an example for illustration in the drawings, and the plurality of pressing ribs 223 are arranged as being lined along the inside of the top of the cover 22 in a longitudinal axial direction; the cover 22 is provided with a control electrics assembly 224 thereon, the control electrics assembly 224 being connectable to an external electrical power source, controlling of the electrical power source for operation of the power unit 3 and supplying of electrical power for the operation being achieved with the control electrics assembly 224; the control electrics assembly 224 is operable by means of touch control or remote control.

As shown in FIGS. 2, 3, 4, and 5, the power unit 3 includes a supporting frame 31, a power machine assembly 32 mounted on the supporting frame 31, a guide roller assembly 33 mounted on the supporting frame 31 and drivable by the power machine assembly 32, a slide bar assembly 34 mounted on the supporting frame 31 and guided by the guide roller assembly 33 to slide, and a rotating assembly 35 mounted on the supporting frame 31 and drivable by the slide bar assembly 34.

As shown in FIGS. 2, 3, 4, and 5, the supporting frame 31 is a support arrangement in the form of an elongate plate, the supporting frame 31 having a top end to which a plurality of shock-absorbing members 311 are attached through clamping, an arrangement of four being taken as an example for illustration in the drawings, the four shock-absorbing members 311 being arranged to correspond to the pressing ribs 223 provided on the cover 22, so that the pressing ribs 223 of the cover 22 may press against the shock-absorbing members 311 so as to provide the top end of the supporting frame 31 with effects of secured positioning and shock absorption; the supporting frame 31 is provided, in an upper side, with a pair of guide slots 312 that are arranged to be penetrating therethrough as a leftward one and a rightward one spaced from each other, the guide slots 312 being curved slots; the supporting frame 31 is provided, in a portion thereof below the pair of guide slots 312, with a pair of slide slots 313 that are arranged to be penetrating therethrough as a leftward one and a rightward one spaced from each other, the slide slots 313 being elongated slots; the supporting frame 31 is provided, at one side thereof on which the power machine assembly 32 is arranged, with a pair of holding members 314 that are arranged as a leftward one and a rightward one, the holding members 314 being at a location between the pairwise arranged leftward and rightward guide slots 312, the pairwise arranged leftward and rightward holding members 314 being recessed to form a holding trough 3141; the supporting frame 31 is provided, in a bottom end, with a plurality of fastening lugs 315 extending outwards from two sides thereof, wherein two fastening lugs 315 extending from each of the two sides are taken as an example for illustration in the drawings, the fastening lugs 315 being formed with a fastening aperture 3151, the plurality of fastening lugs 315 being corresponding to the fastening projections 212 of the base 21, so that fastening elements S may be applied to fasten the fastening lugs 315 to the fastening projections 212 of the base 21, to thereby have the lower end of the supporting frame 31 securely fastened to the base 21 and to provide the lower end of the supporting frame 31 with an effect of shock absorbing by means of the shock-absorbing rings 2121 fit around the outer circumferences of the fastening projections 212; the supporting frame 31 is provided, in two sides of the lower end thereof, with cut-off openings 316, respectively, the cut-off openings 316 being fit into the shock protection pads 2141 of the fitting slots 214 of the base 21, so as to provide effects of secured positioning and shock absorbing on the two sides of the supporting frame 31; the supporting frame 31 is provided, respectively at two sides below the slide slots 313, with locking sections 317, the locking sections 317 being formed of a plurality of locking holes 3171, of which an arrangement of four locking holes 3171 is taken as an example for illustration in the drawings; the supporting frame 31 is further provided with reinforcing ribs 318 for reinforcing purposes.

As shown in FIGS. 2, 3, 4, and 5, the power machine assembly 32 includes a power machine 321, a drive axle 322 extending from the power machine 321, and a worm 323 fit to the drive axle 322; the power machine 321 comprises an electric motor, the power machine 321 being electrically connected to an external electrical power source to acquire electrical power necessary for operation, the power machine 321 being fastened to the supporting frame 31; the drive axle 322 is arranged to extend from the power machine 32, meaning the power machine 321, when in operation, causes the drive axle 322 to rotate, and more specifically, the power machine 321 is mounted at one side of the supporting frame 31, the drive axle 322 being extended from the power machine 321 to penetrate through and reach an opposite side of the supporting frame 31; the worm 323 is mounted to the drive axle 322 through interference fitting, the worm 323 being provided with a worm tooth.

As shown in FIGS. 2, 3, 4, 5, and 6, the guide roller assembly 33 includes a transmission axle 331, a transmission toothed wheel 332 mounted on the transmission axle 331, a pair of roller sets 333 mounted on the transmission axle 331 and arranged as a leftward one and a rightward one, and bearing seats 334 respectively arranged at two ends of the transmission axle 331; the transmission axle 331 is provided with a plurality of fixing locking holes 3311, and an arrangement of six such fixing locking holes 3311 is taken as an example for illustration in the drawings; the transmission toothed wheel 332 includes a through opening 3321 and flanges 3322 extending outwards from outer edges of the through opening 3321, the flanges 3322 being provided with a locking hole 3323, so that the transmission toothed wheel 332 is fit over the transmission axle 331 by means of the through opening 3321, and then, bolts P screw through the locking holes 3323 and the fixing locking holes 3311 to fasten to the transmission axle 331 for positioning, and the transmission toothed wheel 332 is fastened to and positioned on the transmission axle 331 to mate with the worm 323 of the power machine assembly 32, so that the power machine assembly 32 may drive, by means of the worm 323, the transmission toothed wheel 332 and the transmission axle 331 to rotate.

As shown in FIGS. 2, 3, 4, 5, 6, and 7, the roller sets 333 include a first roller 333*a* and a second roller 333*b*, which are respectively arranged at a left side and a right side of the transmission toothed wheel 332 and are fastened to the transmission axle 331; since the roller sets 333 include the first roller 333*a* and the second roller 333*b*, and since the first roller 333*a* and the second roller 333*b* are of structures that are identical, only one of them, which is the first roller 333*a*, is taken as an example for illustration in the following; the first roller 333*a* includes a left half body 333*a*1 and a right half body 333*a*2, the left half body 333*a*1 being provided, in a center thereof, with a penetration section 3331 in a cylindrical form, the penetration section 3331 including a penetration hole 3332, and being formed with connecting locking holes 3333 at two sides of the penetration section 3331 and opened in the same direction as the penetration hole 3332, the left half body 333*al* being provided with a flange section 3334 extending horizontally therefrom along an outer circumference around the penetration section 3331 and the connecting locking holes 3333, the flange section 3334 being provided, at one sideway end, with a stop rim section 3335 that projects in a direction substantially perpendicular to the penetration section 3331, the flange section 3334 and the stop rim section 3335 being arranged in a manner of being perpendicular, the left half body 333*a*1 being provided, in a portion of the penetration section 3331 that is opposite to the flange section 3334, with a locking hole 3336 that penetrates through the penetration section 3331. Similarly, the right half body 333*a*2 is provided, in a center thereof, with a penetration section 3331 in a cylindrical form, the penetration section 3331 including a penetration hole 3332, and being formed with connecting locking holes 3333 at two sides of the penetration section 3331 and opened in the same direction as the penetration hole 3332, the right half body 333*a*2 being provided with a flange section 3334 extending horizontally therefrom along an outer circumference around the penetration section 3331 and the connecting locking holes 3333, the flange section 3334 being provided, at one sideway end, with a stop rim section 3335 that projects in a direction substantially perpendicular to the penetration section 3331, the flange section 3334 and the stop rim section 3335 being arranged in a manner of being perpendicular, the right half body 333*a*2 being provided, in a portion of the penetration section 3331 that is opposite to the flange section 3334, with a locking hole 3336 that penetrates through the penetration section 3331; a gasket O is arranged between the left half body 333*al* and the right half body 333*a*2 of the first roller 333*a*; the left half body 333*al* and the right half body 333*a*2 of the first roller 333*a* are fit onto the transmission axle 331 by means of the penetrate holes 3332, and then, the bolts P are applied to fasten the locking holes 3336 and the fixing locking holes 3311 of the transmission axle 331 for positioning, and finally, fastening elements S penetrate through the connecting locking holes 3333 to fasten and combine the left half body 333*a*1 and the right half body 333*a*2, and to have the flange section 3334 of the left half body 333*al* and the flange section 3334 of the right half body 333*a*2 abutting and jointed to each other, so that the flange section 3334 of the left half body 333*al* and the flange section 3334 of the right half body 333*a*2, and the stop rim section 3335 of the left half body 333*al* and the stop rim section 3335 of the right half body 333*a*2 collectively define a guide track T that is generally of a spiral configuration.

As shown in FIGS. 2, 3, 4, 5, and 7, the bearing seat 334 are arranged at two ends of the transmission axle 331, so as to bear the transmission axle 331 for free rotation; the bearing seats 334 are fastened, at another end, to the locking sections 317 of the supporting frame 31, so as to provide the bearing seat 334 with an effect of securely positioning.

As shown in FIGS. 2, 3, 4, 5, and 7, the slide bar assembly 34 includes a first slide bar 341 and a second slide bar 342; the first slide bar 341 includes a slide bar body 3411, a guide block 3412 arranged at one side of the slide bar body 3411, and a connection section 3413 arranged at an opposite side of the slide bar body 3411; the slide bar body 3411 is a bar in the form of an elongated plate, which has a width that corresponds to a width of the slide slots 313 of the supporting frame 31 and is fit in the slide slots 313 of the supporting frame 31; the guide block 3412 is provided with a locking section 34121 extending from one side thereof, so as to be fastened to the slide bar body 3411 by means of the locking section 34121, the guide block 3412 being received in the guide track T of the roller set 333, and more specifically, the guide block 3412 of the first slide bar 341 is received in the guide track T of the first roller 333*a*, so that when the first roller 333*a* of the roller sets 333 rotates with the transmission axle 331, the guide block 3412 of the first slide bar 341 is caused to move, as being guided by the guide track T of the first roller 333*a*, to thereby drive the slide bar body 3411 of the first slide bar 341 to do leftward and rightward shifting in the slide slot 313 of the supporting frame 31; the connection section 3413 is connected to the rotating assembly 35. The second slide bar 342 includes a slide bar body 3421, a guide block 3422 arranged at one side of the slide bar body 3421, and a connection section 3423 arranged at an opposite side of the slide bar body 3421; the slide bar body 3421 is a bar in the form of an elongated plate, which has a width that corresponds to a width of the slide slots 313 of the supporting frame 31 and is fit in the slide slots 313 of the supporting frame 31; the guide block 3422 is provided with a locking section 34221 extending from one side thereof, so as to be fastened to the slide bar body 3421 by means of the locking section 34221, the guide block 3422 being received in the guide track T of the roller set 333, and more specifically, the guide block 3422 of the second slide bar 342 is received in the guide track T of the second roller 333*b*, so that when the first roller 333*a* of the roller sets 333 rotates with the transmission axle 331, the guide block 3412 of the first slide bar 341 is caused to move, as being guided by the guide track T of the first roller 333*a*, to thereby drive the slide bar body 3411 of the first slide bar 341 to do leftward and rightward shifting in the slide slot 313 of the supporting frame 31.

As shown in FIGS. 2, 3, 4, 5, 7, and 8, the rotating assembly 35 includes a first rotating member 35*a* and a second rotating member 35*b*; the first rotating member 35*a* and the second rotating member 35*b* are of structures that are identical, and a specific structure of the first rotating member 35*a* is taken as an example for illustration in the following; the first rotating member 35*a* includes a rotating body 351, and the rotating body 351 looks like a Z-shape when observed sideways, the rotating body 351 having an upper end that includes a fastening section 352, the fastening section 352 being formed with a plurality of fastening apertures 3521, the fastening section 352 being provided for fastening with the support unit 4, the fastening section 352 being provided, on one side surface, with a pivoting seat 353, the pivoting seat 353 being provided with a pivot axle 354, the pivot axle 354 having an end that is provided with a base circle end 3541 having an enlarged outside diameter and an opposite end that is extended to form a locking segment 3542, the pivoting seat 353 having an inner circumference that is provided with a plurality of positioning locking holes 3531, so that the pivot axle 354 is inserted, by means of the base circle end 3541, into the pivoting seat 353, and positioning screws S1 are screwed into the positioning locking holes 3531 to have heads of the positioning screws S1 constrain the base circle end 3541 and thus having the pivot axle 354 securely positioned in the pivoting seat 353 without departing therefrom; the locking segment 3542 of the pivot axle 354 penetrates into the penetrating hole 2161 of the fastening plate 216 to have the pivot axle 354 fastened in the penetrating hole 2161 of the fastening plate 216; the rotating body 351 is provided, in a middle portion thereof, with a positioning fastening aperture 355 penetrating therethrough, the positioning fastening aperture 355 corresponding to one of two positioning holes 412 of the support unit 4, and fastening and positioning being achieved with fastening elements S; the rotating body 351 is provided, on an upper side of a lower portion thereof, with a guide constraining member 356, the guide constraining member 356 having an end fastened to the rotating body 351 and an opposite end received into the guide slot 312 of the supporting frame 31, so that a rotation angle of the first rotating member 35*a* is constrainable; the rotating body 351 is provided, in a lower side of the lower portion thereof, with a coupling hole 357, the coupling hole 357 being an elongated opening, the lower side of the lower portion of the rotating body 351 being coupled to the connection section 3413 at one side of the slide bar body 3411 by having a fastening element S penetrating into and fastened to the coupling hole 357.

As shown in FIGS. 1, 2, 3, 4, 5, 7, and 8, the support unit 4 includes a first support base 41 and a second support base 42; the first support base 41 and the second support base 42 are of structures that are identical, and only the first support base 41 is taken as an example for illustration in the following, the first support base 41 and the second support base 42 being specifically structured; the first support base 41 is a support having a generally U-shape, so that the first support base 41 may receive and support an ankle of a user positioned therein, the first support base 41 being located outside the mounting holes 221 of the cover 22, meaning the first support base 41 is fastened, at a lower end portion thereof, to the rotating assembly 35 within the mounting holes 221 of the cover 22; a circumference of a lower portion of the first support base 41 is provided with a plurality of fastening holes 411, so that fastening elements S may be applied to fasten the fastening holes 411 and the fastening apertures 3521 of the fastening section 352 of the rotating assembly 35, to thereby have the first support base 41 securely fixed to the fastening section 352 of the rotating assembly 35, the first support base 41 being provided, in a bottom thereof, with two positioning holes 412, so that fastening elements S may be applied to fasten to the positioning fastening apertures 355 of the rotating body 351, and also, the first support base 41 is drivable by the rotating assembly 35 to conduct a motion of leftward and rightward rotation; specifically, the power machine assembly 32 of the power unit 3 drives the guide roller assembly 33, and the guide roller assembly 33 guides the slide bar assembly 34 to shift, and the slide bar assembly 34 drives the rotating assembly 35 to rotate, and the rotating assembly 35 drives the support unit 4 to conduct the motion of leftward and rightward rotation.

Figure 9:
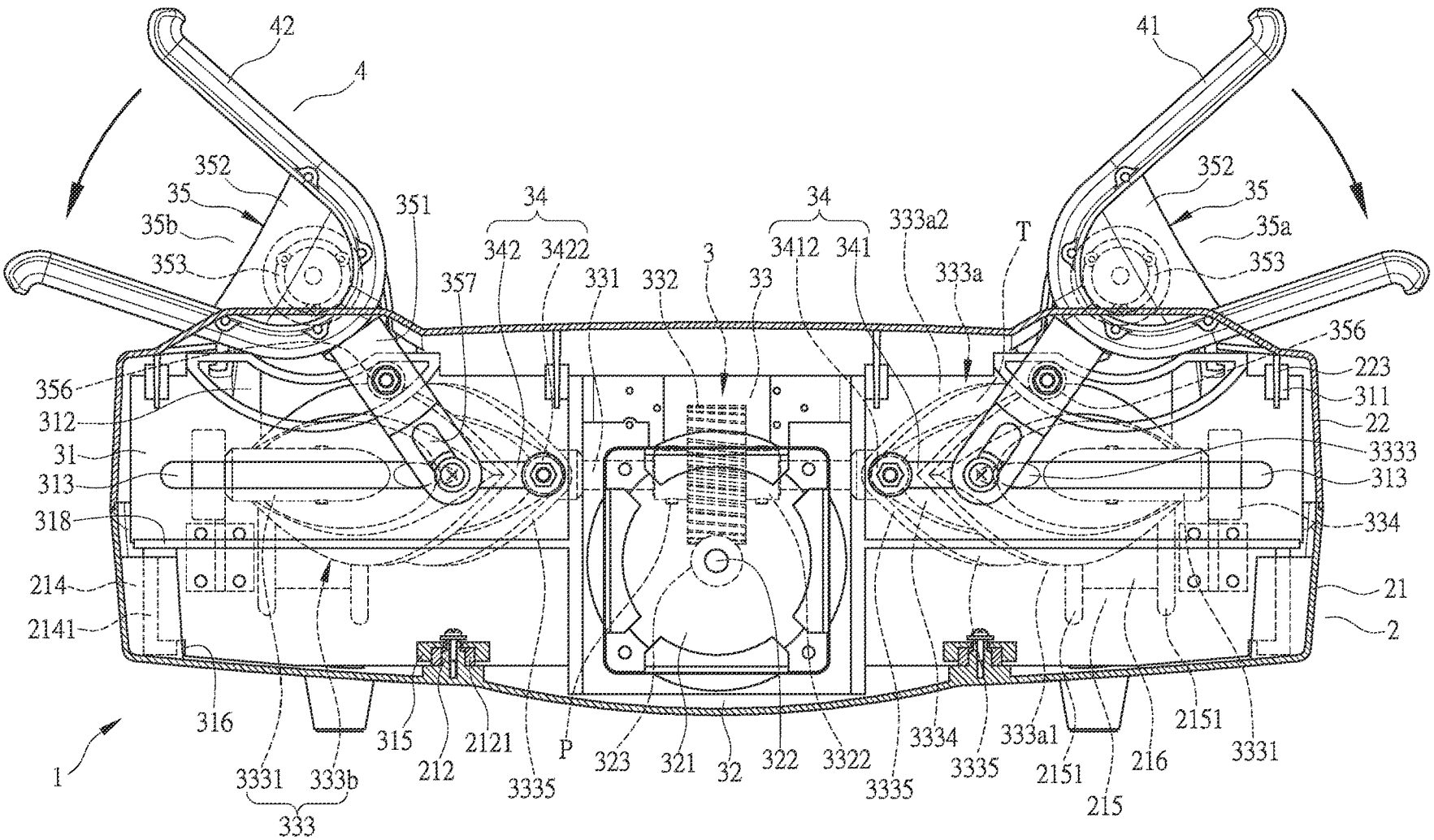
FIGS. 9 and 10 are schematic views illustrating motions of the support units of the exercise apparatus according to the present invention conducted in different directions.
Figure 10:
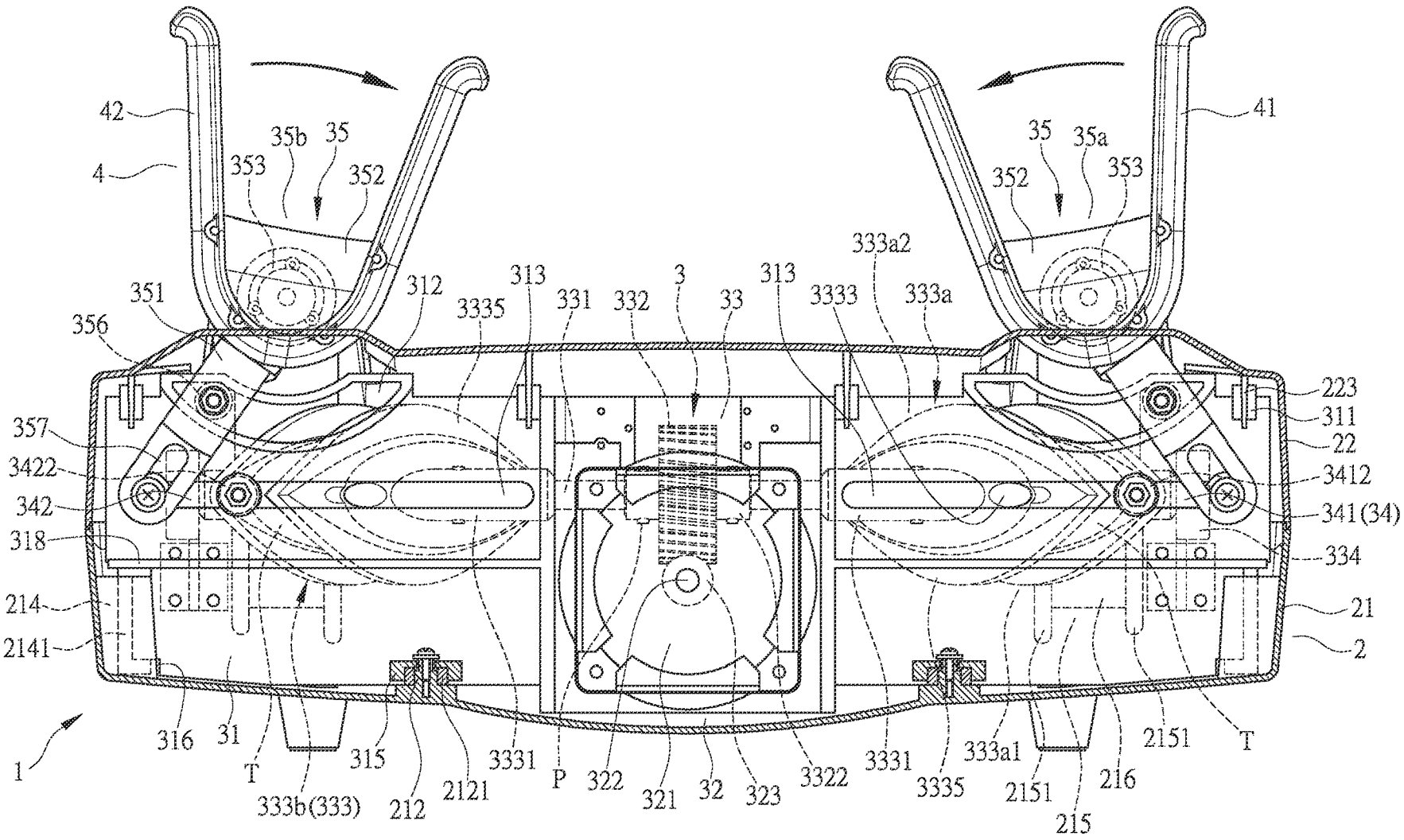

As shown in FIGS. 1, 9, and 10, to implement the exercise apparatus 1 of the present invention, the exercise apparatus 1 is connected to an external electrical power source to acquire electrical power necessary for operation; a user places the ankle (of one foot or each of two feet) on the support unit 4 and operates the control electrics assembly 224 to activate operation of the power unit 3, so that the power machine assembly 32 of the power unit 3 drive the guide roller assembly 33, the guide roller assembly 33 guiding the slide bar assembly 34 to shift, the slide bar assembly 34 driving the rotating assembly 35 to rotate, the rotating assembly 35 then driving the support unit 4 to conduct motions of rotating in different directions either leftward or rightward, wherein when the rotating assembly 35 is conducting a motion for rotating in different directions, the entire lower limb (leg) of the user is forced to do a spinning like rotating motion, to thereby exercise the muscles and the meridian system of the entire lower limb of the user by which an effect of body building and heath care can be achieved.

Figure 11:
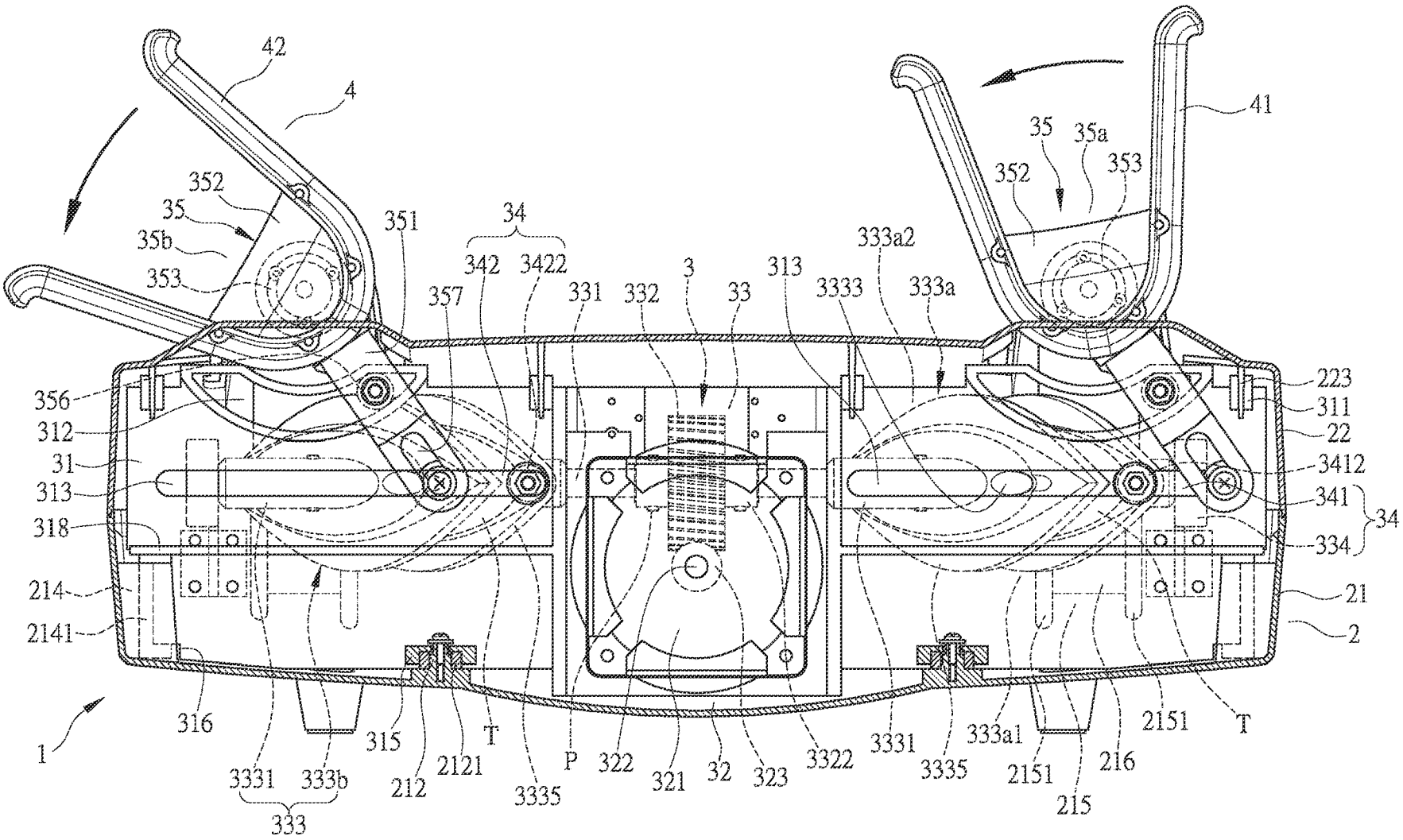
FIG. 11 is a schematic view showing motions of the support units of the exercise apparatus according to the present invention conducted in the same direction.

As shown in FIG. 11, the exercise apparatus 1 of the present invention may further change the direction of the guide tracks T of the roller sets 333 so as to have the rotating assembly 35 to conduct rotating motions simultaneously in the same direction of leftward and rightward.

Figure 12:
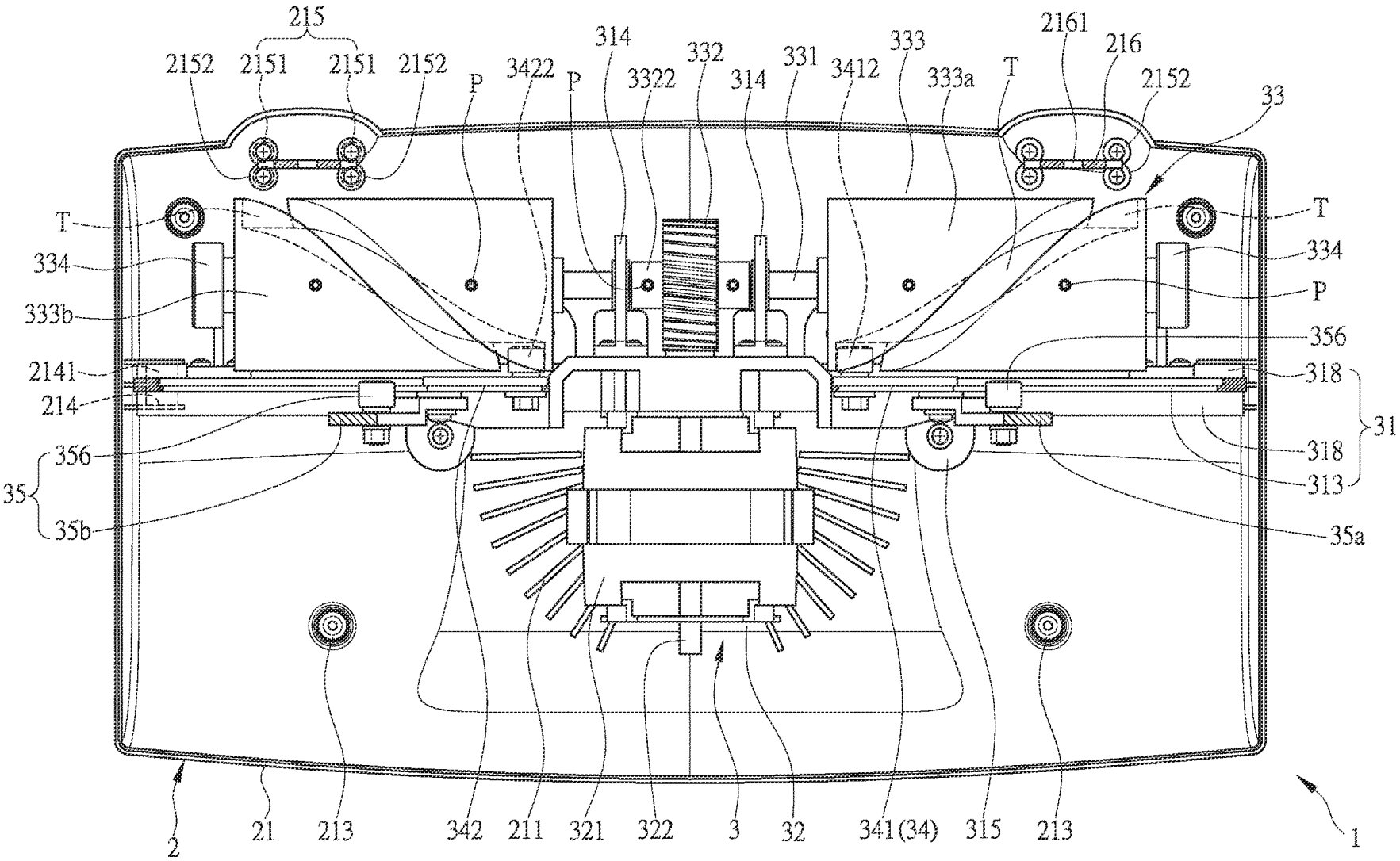
FIG. 12 shows another example of the guide roller assembly of the exercise apparatus according to the present invention.

As shown in FIG. 12, the exercise apparatus 1 of the present invention may be such that the first roller 333*a* and the second roller 333*b* of the roller sets 333 are integrally formed together in a one-piece manner, wherein the first roller 333*a* and the second roller 333*b* are recessed to form a spiral groove that forms the guide track T.

The efficacy of the present invention resides in that the exercise apparatus 1 comprises a casing unit 2, a power unit 3 arranged inside the casing unit 2, and a support unit 4 drivable by the power unit 3 to conduct a rotating motion, and a user may place an ankle on the support unit 4, such that the power unit 3 drives the support unit 4 to do rotating motions in different leftward and rightward directions or in the same direction, by which the entire lower limb (leg) of the user is caused to do a spinning like rotating motion, to thereby exercise the muscles and the meridian system of the entire lower limb of the user by which an effect of body building and heath care can be achieved.

I claim:

1. An ankle-spinning exercise apparatus, the exercise apparatus comprising a casing unit, a power unit arranged in an interior of the casing unit, and a support unit drivable by the power unit to do a rotating motion, the support unit being adapted to receive an ankle of a user to place thereon, wherein the power unit drives a rotating assembly and the rotating assembly is fastened with the support unit, and wherein the support unit comprises a first support base and a second support base, each of which is drivable by the power unit to rotate about a fixed axis that is fixed relative to the casing unit, and the power unit drives the first support base and the second support base of the support unit to rotate in either different direction or in a same direction for each supporting entirety of a lower limb of the user to spin in a manner of being like a rotating motion.

2. The ankle-spinning exercise apparatus according to claim 1, wherein the casing unit comprises a base and a cover set on and covering the base; the base comprises a heat dissipation section, a plurality of fastening projections being arranged adjacent to the heat dissipation section, shock-absorbing rings being fit around outer circumferences of the fastening projections; the base is provided with a plurality of fastening pegs on a bottom thereof; the base is provided with a pair of fitting slots that are arranged, in a manner of being opposite to each other, as a leftward one and a rightward one on two sidewalls thereof, shock protection pads having sideway openings being embedded in the fitting slots; the base is provided with fastening sections that are arranged to space from each other in a longitudinal axial direction along a side of a long-side sidewall, the fastening sections receiving fastening sheets to fasten thereto, the fastening sections receiving fastening plates to insert therein, the fastening plates being provided, in an upper portion, with a penetrating through hole, the fastening plates being provided, in a lower portion, with a pair of fixing notches that are recessed inward and are arranged as a leftward one and a rightward one.

3. The ankle-spinning exercise apparatus according to claim 2, wherein the cover is formed in a top thereof with two mounting holes that are spaced from each other and penetrating therethrough; the cover is provided with a plurality of attaching pillars corresponding to the fastening pegs of the base; the cover is provided with a plurality of pressing ribs extended downward from an inner side of the top thereof; the cover is provided with a control electrics assembly thereon, the control electrics assembly being connectable to an external electrical power source.

4. The ankle-spinning exercise apparatus according to claim 1, wherein the power unit comprises a supporting frame, a power machine assembly mounted on the supporting frame, a guide roller assembly mounted on the supporting frame and drivable by the power machine assembly, a slide bar assembly mounted on the supporting frame and guided by the guide roller assembly to slide, and the rotating assembly mounted on the supporting frame and drivable by the slide bar assembly.

5. The ankle-spinning exercise apparatus according to claim 4, wherein the supporting frame has a top end to which a plurality of shock-absorbing members are attached through clamping; the supporting frame is provided, in an upper side, with a pair of guide slots that are arranged to be penetrating therethrough as a leftward one and a rightward one spaced from each other; the supporting frame is provided, in a portion thereof below the pair of guide slots, with a pair of slide slots that are arranged to be penetrating therethrough as a leftward one and a rightward one spaced from each other; the supporting frame is provided, at one side thereof on which the power machine assembly is arranged, with a pair of holding members that are arranged as a leftward one and a rightward one, the holding members being at a location between the pairwise arranged leftward and rightward guide slots; the supporting frame is provided, in a bottom end, with a plurality of fastening lugs extending outwards from two sides thereof; the supporting frame is provided, in two sides of a lower end thereof, with cut-off openings, respectively; the supporting frame is provided, respectively at two sides below the slide slots, with locking sections.

6. The ankle-spinning exercise apparatus according to claim 5, wherein the guide slots are curved slots; the slide slots are elongated slots; the holding members are recessed to form holding troughs; the supporting frame is further provided with reinforcing ribs for reinforcing purposes.

7. The ankle-spinning exercise apparatus according to claim 4, wherein the power machine assembly comprises a power machine, a drive axle extending from the power machine, and a worm fit to the drive axle; the power machine is fastened to the supporting frame; the drive axle is arranged to extend from the power machine; the worm is provided with a worm tooth.

8. The ankle-spinning exercise apparatus according to claim 4, wherein the guide roller assembly comprises a transmission axle, a transmission toothed wheel mounted on the transmission axle, a pair of roller sets mounted on the transmission axle and arranged as a leftward one and a rightward one, and bearing seats respectively arranged at two ends of the transmission axle; the transmission axle is provided with a plurality of fixing locking holes; the transmission toothed wheel comprises a through opening and flanges extending outwards from outer edges of the through opening, the flanges being provided with locking holes.

9. The ankle-spinning exercise apparatus according to claim 8, wherein the roller sets comprise a first roller and a second roller, which are respectively arranged at a left side and a right side of the transmission toothed wheel and are fastened to the transmission axle; the first roller and the second roller comprise a left half body and a right half body, the left half body being provided, in a center thereof, with a penetration section in a cylindrical form, the penetration section comprising a penetration hole, and being formed with connecting locking hole at two sides of the penetration section and opened in a same direction as the penetration hole, the left half body being provided with a flange section extending horizontally therefrom along an outer circumference around the penetration section and the connecting locking hole, the flange section being provided, at one sideway end, with a stop rim section that projects in a direction substantially perpendicular to the penetration section, the flange section and the stop rim section being arranged in a manner of being perpendicular, the left half body being provided, in a portion of the penetration section that is opposite to the flange section, with a locking hole that penetrates through the penetration section; the right half body is provided, in a center thereof, with a penetration section in a cylindrical form, the penetration section including a penetration hole, and being formed with connecting locking hole at two sides of the penetration section and opened in a same direction as the penetration hole, the right half body being provided with a flange section extending horizontally therefrom along an outer circumference around the penetration section and the connecting locking hole, the flange section being provided, at one sideway end, with a stop rim section that projects in a direction substantially perpendicular to the penetration section, the flange section and the stop rim section being arranged in a manner of being perpendicular, the right half body being provided, in a portion of the penetration section that is opposite to the flange section, with a locking hole that penetrates through the penetration section; a gasket is arranged between the left half body and the right half body; the flange section of the left half body and the flange section of the right half body, and the stop rim section of the left half body and the stop rim section of the right half body collectively define a guide track that is generally of a spiral configuration.

10. The ankle-spinning exercise apparatus according to claim 8, wherein the roller sets comprise a first roller and a second roller, which are integrally formed together as a one piece, wherein the first roller and the second roller are recessed to form a spiral groove that forms a guide track.

11. The ankle-spinning exercise apparatus according to claim 4, wherein the slide bar assembly comprises a first slide bar and the second slide bar.

12. The ankle-spinning exercise apparatus according to claim 11, wherein the first slide bar and the second slide bar comprise a slide bar body, a guide block arranged at one side of the slide bar body, and a connection section arranged at an opposite side of the slide bar body.

13. The ankle-spinning exercise apparatus according to claim 4, wherein the rotating assembly comprises a first rotating member and a second rotating member.

14. The ankle-spinning exercise apparatus according to claim 13, wherein the first rotating member and the second rotating member comprise a rotating body, the rotating body having an upper end that comprises a fastening section, the fastening section being formed with a plurality of fastening apertures, the fastening section being provided, on one side surface, with a pivoting seat, the pivoting seat being provided with a pivot axle, the pivot axle having an end that is provided with a base circle end having an enlarged outside diameter and an opposite end that is extended to form a locking segment, the pivoting seat having an inner circumference that is provided with a plurality of positioning locking holes; the rotating body is provided, in a middle portion thereof, with a positioning fastening aperture penetrating therethrough; the rotating body is provided, on an upper side of a lower portion thereof, with a guide constraining member, the guide constraining member having an end fastened to the rotating body; the rotating body is provided, in a lower side of the lower portion thereof, with a coupling hole, the coupling hole being an elongated opening.

* * * * *